US008146175B2

(12) United States Patent
Otenbaker

(10) Patent No.: US 8,146,175 B2
(45) Date of Patent: Apr. 3, 2012

(54) SCARF HARNESS

(76) Inventor: Audrey Lee Otenbaker, Sterling Heights, MI (US)

( * ) Notice: Subject to any disclaimer, the term of this patent is extended or adjusted under 35 U.S.C. 154(b) by 1141 days.

(21) Appl. No.: 11/782,245

(22) Filed: Jul. 24, 2007

(65) Prior Publication Data

US 2009/0025187 A1 Jan. 29, 2009

(51) Int. Cl.
*A42B 5/00* (2006.01)

(52) U.S. Cl. ..... 2/207; 2/279; 450/30

(58) Field of Classification Search ..... 2/84, 202, 2/203, 207, 49.1, 69, 46, 48, 171, 410, 209.13, 2/88, 144, 27.9, 243.1, 206, 279, 67, 238, 2/228, 1, 102–106; 450/1, 2, 3, 6, 7, 8, 9, 450/10, 11, 14, 15, 16, 17, 19, 23, 26, 28, 450/30, 33, 58, 79, 86, 88, 67, 68, 66, 31, 450/32, 41, 45, 50, 53, 60, 62, 63, 64, 80, 450/81, 75, 78, 73, 77, 87, 74; 132/273, 132/275, 277; 24/3.12, 3.1; 66/171; 446/27; 128/874, 888, 889, 875, 873, 157; D2/701, D2/706–716, 704, 720, 731, 477
See application file for complete search history.

(56) References Cited

U.S. PATENT DOCUMENTS 1,917,908 A * 7/1933 Stolz ..... 450/22
1,989,309 A * 1/1935 Fowler ..... 2/46
2,023,612 A * 12/1935 Park et al. ..... 450/88
2,106,102 A * 1/1938 Le Coney ..... 2/92
2,414,590 A * 1/1947 Folb ..... 450/45
2,493,179 A * 1/1950 Wittenberg ..... 450/32
2,568,175 A * 9/1951 Ullrich ..... 450/54
2,585,686 A * 2/1952 Rossant ..... 2/91
2,896,630 A * 7/1959 Adler ..... 450/30
3,080,566 A * 3/1963 Neumann ..... 2/91
3,311,112 A * 3/1967 Murray ..... 450/1
3,360,802 A * 1/1968 Euchi ..... 2/207
3,473,167 A * 10/1969 Jeffrey ..... 2/74
3,748,661 A * 7/1973 Smith ..... 2/207
3,826,266 A * 7/1974 Alpert ..... 450/11
4,199,822 A * 4/1980 Vasquez ..... 2/106
4,411,269 A * 10/1983 Weintraub ..... 450/58
4,570,266 A * 2/1986 Schlosser ..... 2/69
4,870,707 A * 10/1989 Hayes ..... 2/207
4,891,846 A * 1/1990 Sager et al. ..... 2/48
4,956,878 A * 9/1990 Boynton ..... 2/67
5,144,696 A * 9/1992 Kahl ..... 2/207
5,538,502 A * 7/1996 Johnstone ..... 602/79
6,068,538 A * 5/2000 Alleyne ..... 450/58
6,099,382 A * 8/2000 Wilson ..... 450/89
6,155,906 A * 12/2000 May ..... 450/88
6,240,560 B1 * 6/2001 DeCaro ..... 2/67
6,421,833 B2 * 7/2002 Khanamirian et al. ..... 2/69

(Continued)

*Primary Examiner* — Gary L Welch
*Assistant Examiner* — Khaled Annis
(74) *Attorney, Agent, or Firm* — Harness, Dickey & Pierce, P.L.C.

(57) ABSTRACT

A scarf harness according to the present teachings facilitates the wearing of a scarf as a clothing accessory. The harness can allow the scarf to drape across the front of a user. The draping of a scarf can allow the visual pattern of the scarf to be easily seen and can enhance the impact of the scarf as a clothing accessory. The scarf harness can retain the scarf in a draped function over the front of the user along with providing a distinctive butterfly-type shape to the scarf.

19 Claims, 3 Drawing Sheets

U.S. PATENT DOCUMENTS

| | | | | |
|---|---|---|---|---|
| 6,620,010 | B2 * | 9/2003 | Noonan | 441/106 |
| 7,089,597 | B2 * | 8/2006 | Horii et al. | 2/69 |
| 7,222,372 | B1 * | 5/2007 | Bruckart et al. | 2/106 |
| 2003/0003844 | A1 * | 1/2003 | Jones et al. | 450/88 |
| 2005/0054264 | A1 * | 3/2005 | Ward et al. | 450/28 |
| 2005/0109361 | A1 * | 5/2005 | Klug | 132/275 |
| 2006/0218690 | A1 * | 10/2006 | James | 2/69 |

* cited by examiner

FIG 1
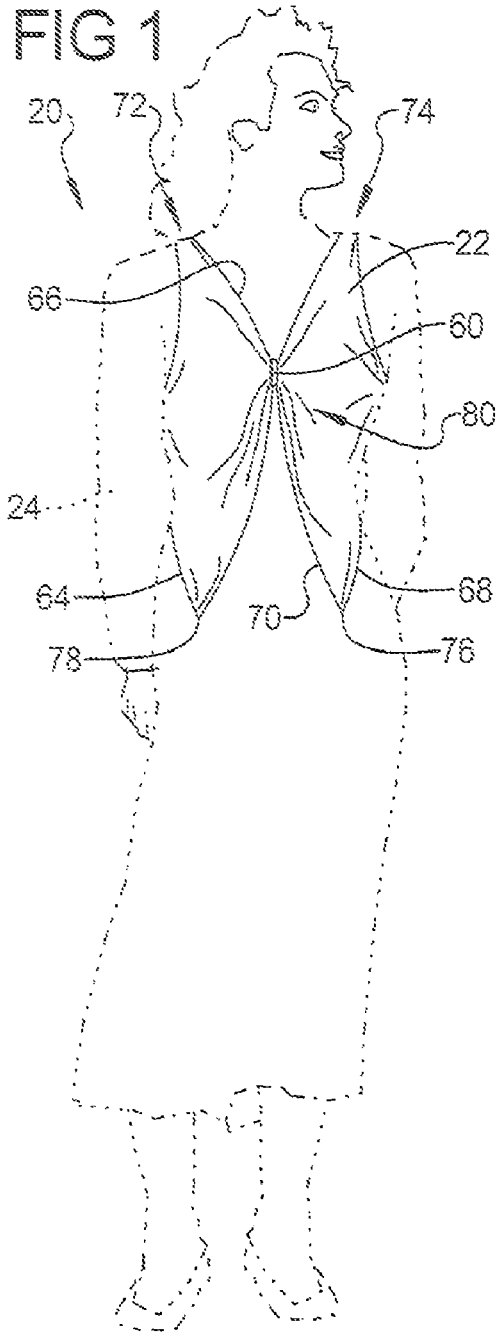
FIG 2
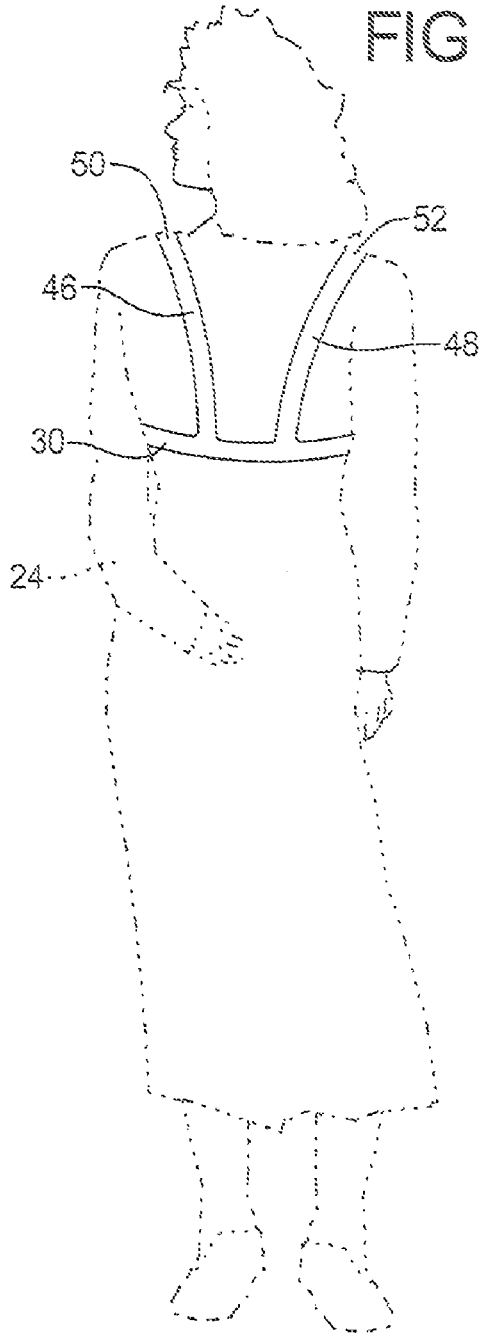
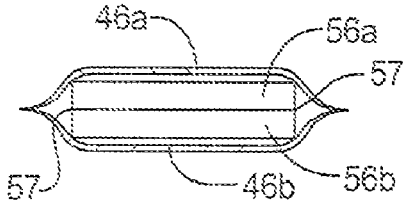
FIG 6A
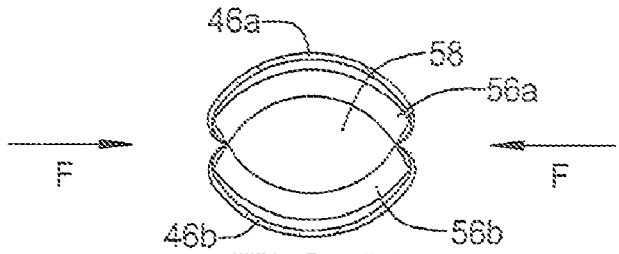
FIG 6B

FIG 3
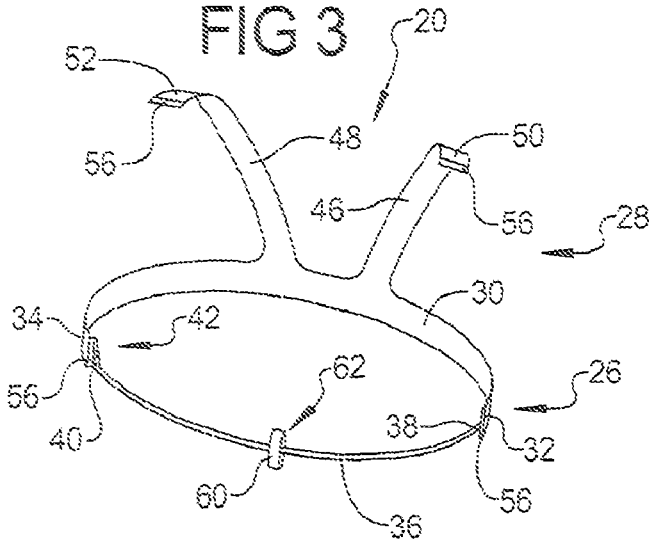
FIG 4
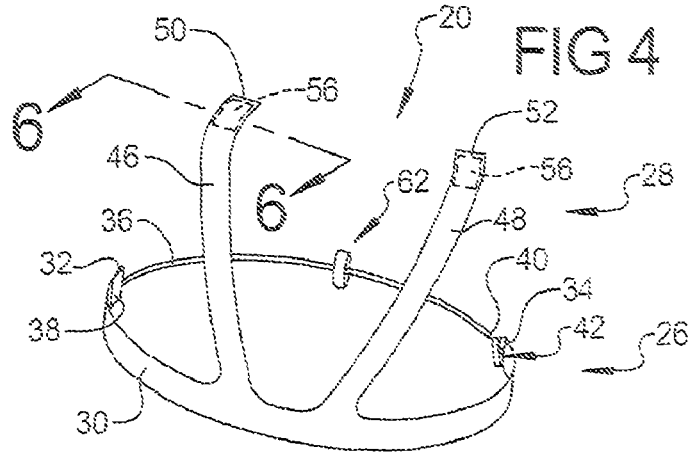
FIG 7
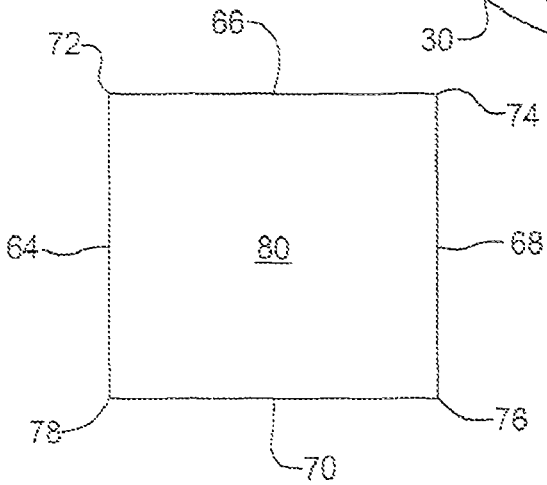
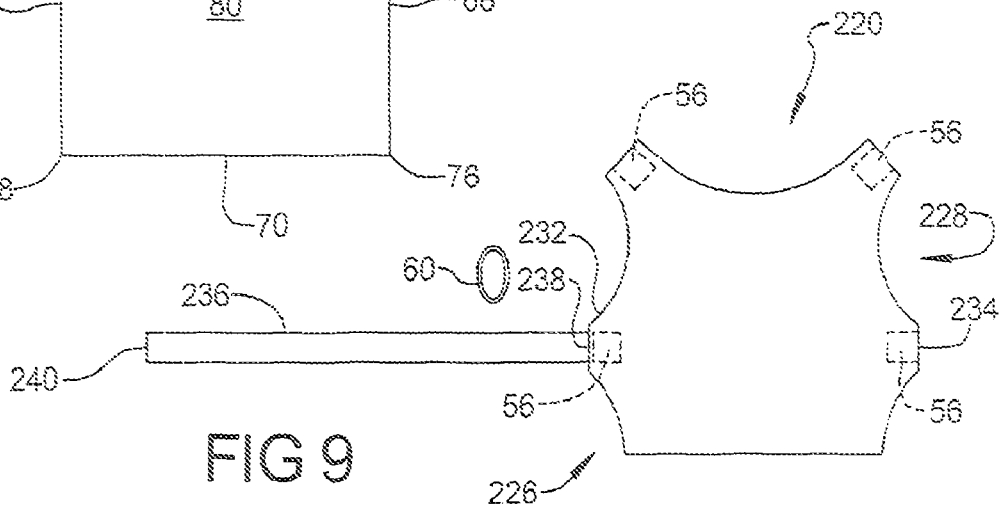
FIG 9

SCARF HARNESS

FIELD

The present teachings relate to clothing and, particularly, to a harness that facilitates the wearing of a scarf as a clothing accessory.

BACKGROUND AND SUMMARY

The statements in this section merely provide background information related to the present teachings and may not constitute prior art.

Scarves can be used as clothing accessories. Typically, the scarf is folded up and worn around the neck. When folded up, however, the pattern of the scarf can be obscured and/or partially hidden. As a result, the visual impact of the scarf may be diminished.

A scarf harness according to the present teachings facilitates the wearing of a scarf as a clothing accessory. The harness can allow the scarf to drape across the front of a user. The draping of a scarf can allow the visual pattern of the scarf to be easily seen and can enhance the impact of the scarf as a clothing accessory. The scarf harness can retain the scarf in a draped function over the front of the user along with providing a distinctive butterfly-type shape to the scarf.

Further areas of applicability will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

FIGS. 1 and 2 are respective front and rear plan views of a scarf being retained on a user with a scarf harness according to the present teachings;

FIGS. 3 and 4 are respective front and rear perspective views of the scarf harness according to the present teachings;

Figure 8:
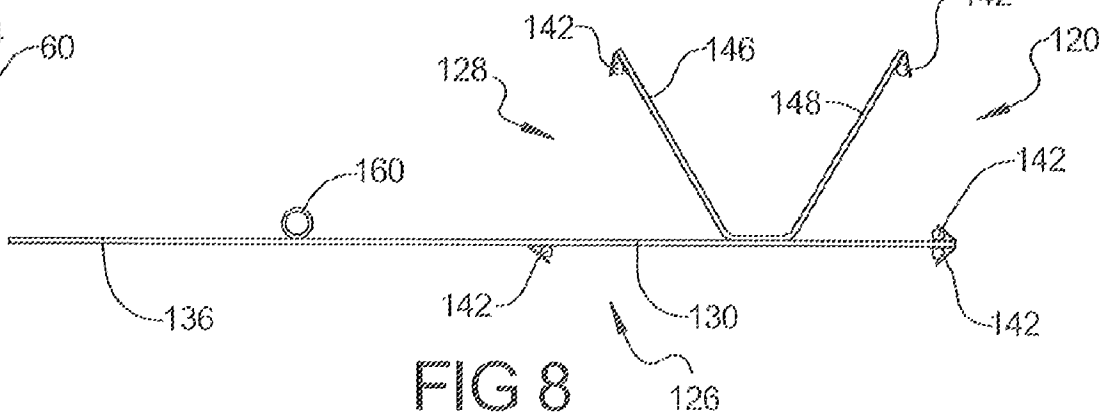
Figure 10:
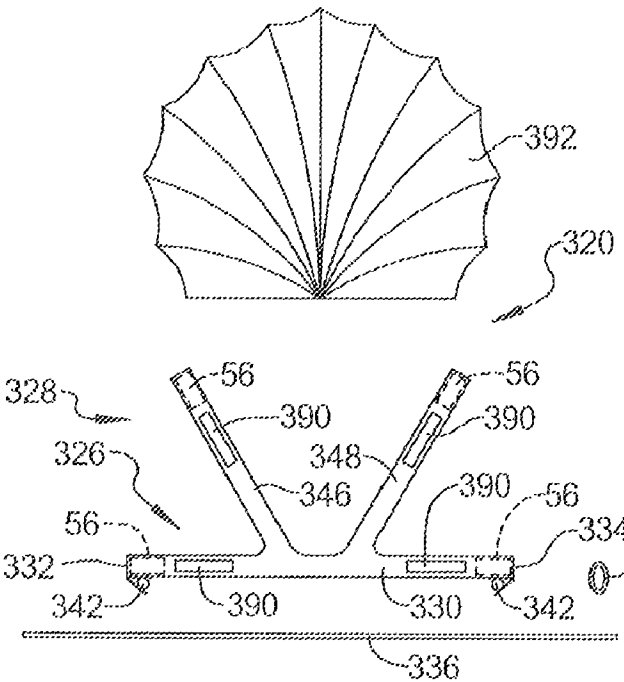

FIGS. 6A and B are cross-sectional views along lines 6-6 of FIG. 4 showing the fastening device in a closed and open position, respectively;

FIG. 7 is a plan view of an exemplary scarf that can be used with a scarf harness according to the present teachings;

FIG. 8 is a plan view of another scarf harness according to the present teachings;

FIG. 9 is a plan view of another scarf harness according to the present teachings; and FIG. 10 is yet another scarf harness according to the present teachings.

DETAILED DESCRIPTION

The following description is merely exemplary in nature and is not intended to limit the present teachings, application, or uses. It should be understood that throughout the drawings, corresponding reference numerals indicate like or corresponding parts and features (e.g., 20, 120, 220, etc.).

Referring to FIGS. 1-5, a scarf harness 20 according to the present teachings is shown. Harness 20 is operable to retain a scarf 22 on a person/user 24 (shown in phantom) to serve as a clothing accessory. Harness 20 can include a torso portion 26 configured to extend along a torso of user 24 and a shoulder portion 28 configured to extend from torso portion 26 up along the rear portion of user 24 onto the shoulders.

Figure 5:
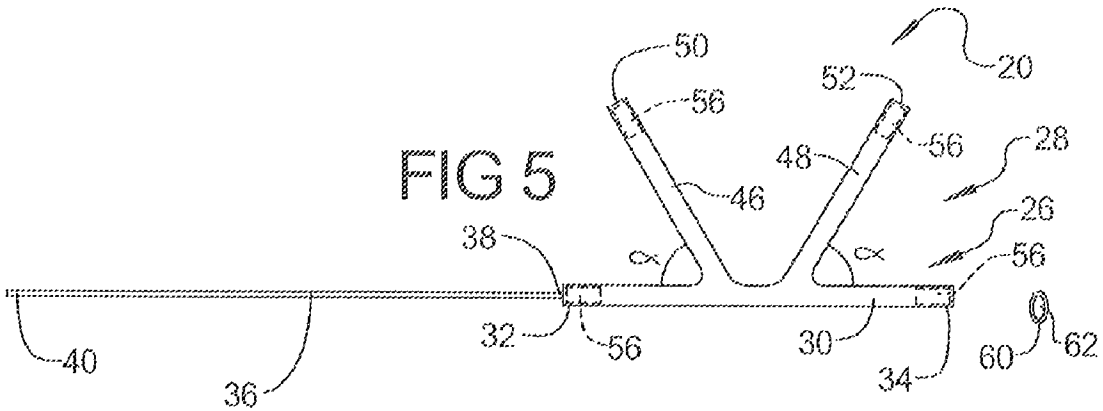
FIG. 5 is a plan view of the scarf harness of FIG. 3.

Torso portion 26 can include a rear torso strap 30 with left and right ends 32, 34. Torso portion 26 can include a front torso strap 36 with left and right ends 38, 40. One end of front torso strap 36 can be fixedly connected to one of the ends of rear torso strap 30 while the other ends of front and rear torso straps 36, 30 are free ends. For example, as depicted in FIGS. 3-5, left end 38 of front torso strap 36 can be fixedly coupled to left end 32 of rear torso strap 30 while right end 40 of front torso strap 36 and right end 34 of rear torso strap 30 are free ends. The free ends of front and rear torso straps 36, 30 can be removably coupled together when using harness 20. For example, a fastening device 42 can be used to couple the free ends together. The fastening device can include a clip 42, as shown, or other types of fastening devices such as snaps, buttons, and hook-and-loop fasteners. It should be appreciated, that the description of suitable fastening members is merely exemplary and that other fastening members or means can be utilized.

Shoulder portion 28 can include left and right shoulder straps 46, 48. One end of each shoulder strap 46, 48 can be integral with torso portion 26, as shown. In some embodiments, shoulder straps 46, 48 can be separate and distinct components that can be selectively attached to torso portion 26. Left and right shoulder straps 46, 48 have respective free ends 50, 52. Shoulder straps 46, 48 extend upwardly from torso portion 26. Shoulder straps 46, 48 can extend upwardly from torso portion 26 at an angle $\alpha$. Angle $\alpha$ can be an acute angle. Each shoulder strap 46, 48 can extend upwardly from different sections of rear torso strap 30, as shown. In some embodiments, shoulder straps 46, 48 can extend upwardly from a same section of rear torso strap 30.

Free ends 50, 52 of shoulder straps 46, 48 are configured to extend upwardly along the back of user 24, as shown in FIG. 1, and to attach to adjacent corners of scarf 22. Fastening devices 56 can be used to secure scarf 22 to free ends 50, 52 of shoulder straps 46, 48, as described below. Fastening devices 56 are also located in left and right ends 32, 34 of rear torso strap 30 to secure portions of scarf 22 thereto, as described below.

Referring now to FIGS. 6A and B, details of one exemplary type of fastening device 56 are shown. In this embodiment, fastening device 56 is a snap fastener that can be deformed to form a cavity 58 therein within which portions of scarf 22 can be inserted and secured. Fastening device 56 can include upper and lower members 56*a*, 56*b* that are attached together along their adjacent longitudinal sides 57. As shown in FIG. 6B, the application of a force F to opposite sides 57 causes upper and lower portions 56*a*, 56*b* to deform away from one another and a cavity 58 to appear therebetween. The resilient nature of portions 56*a*, 56*b* causes them to come back together upon release of force F, as shown in FIG. 6A. In this manner, fastening device 56 can be opened to allow portions of scarf 22 to be inserted therein and then closed onto the portions of the scarf to retain the scarf therein. In some embodiments, fastening devices 56 can be disposed internally to the portions of scarf harness 20. For example, as shown in FIGS. 6A and 6B, fastening device 56 can be disposed with an upper or lower portion 46*a*, 46*b* of left shoulder strap 46. Fastening devices 56 on left and right ends 32, 34 of rear torso strap 30 and in right shoulder strap 48 can be similarly constructed. In some embodiments, fastening devices 56 can be external to the associated portion of harness 20.

It should be appreciated that fastening devices 56 can take a variety of other forms different than that shown and discussed above. For example, fastening devices 56 can be external clips that can be operated to selectively retain portions of the scarf thereto. In some embodiments, the fastening devices may appear simply as a slot through the associated portion of scarf harness 20 through which a portion of the scarf can be inserted.

Scarf harness 20 can also include a gathering member 60 that can be coupled to front torso strap 36. Gathering member 60 is operable to receive scarf 22 therein and to bunch a central portion of scarf 22 together, as shown in FIG. 1. Gathering member 60 can take a variety of forms. For example, in some embodiments gathering member 60 is a solid annular or ring member with a central opening 62 extending therethrough. In some embodiments, gathering member 60 can be oblong, as shown in FIGS. 1-5. In some embodiments, gathering member 60 can have a circular periphery, such as shown in FIG. 8. In some embodiments, gathering member 62 can be a multi-component member operable to open and close to bunch the central portion of scarf 22 together. In some embodiments, gathering member 60 can be a clip, pin, broach, and the like. In some embodiments, gathering member 60 can have an accessory, such as jewelry, broaches, decorative pieces, ribbons and the like, attached thereto, by way of non-limiting example. It should be appreciated, however, that gathering member 60 can take a variety of forms and that the above mentioned forms are merely exemplary.

Scarf harness 20 is operable to retain a scarf 22 on the body of a user, as shown in FIGS. 1 and 2. Scarf 22, as shown in FIG. 7, can be rectangular. When rectangular, scarf 22 can include four sides 64, 66, 68, 70 with four corners 72, 74, 76, 78. Scarf 22 can be made from a variety of materials and can include a variety of patterns thereon.

To use scarf harness 20, adjacent ends, such as ends 74, 76 of scarf 22, are brought together and inserted through opening 62 in gathering member 60 until a central portion 80 of scarf 22 is in gathering member 60. Other adjacent corners, such as corner 72, 74 of scarf 22, can then be connected to respective left and right free ends 50, 52 of shoulder straps 46, 48 with the associated fastening devices 56. The head of user 24 can be inserted into the opening created between shoulder straps 46, 48 and side 66 of scarf 22 to position ends 72, 74 of scarf 22 on the shoulders of user 24 with shoulder straps 46, 48 extending along the back of user 24. Free end 40 of front torso strap 36 can be coupled to gathering member 60, such as by inserting front torso strap 36 through opening 62 to secure gathering member 60 to front torso strap 36. Free end 40 can then be coupled to free end 34 of rear torso strap 30 with clip 42. Additionally, the central sections of sides 64, 68 of scarf 22 can be coupled to the associated respective right and left ends 34, 32 of rear torso strap 30 with fastening devices 56. As a result, scarf 22 can cover a front portion of user 24 and can form a generally butterfly-type configuration, as shown in FIG. 1, when worn by user 24. Ends 76, 78 are free to move while ends 72, 74 are secured to scarf harness 20 along with central sections of sides 68, 64. Front torso strap 36 and gathering member 60 limit the movement of scarf 22 relative to the front portion of user 24, such as when bending over and moving around. Gathering member 60 causes central portion 80 of scarf 22 to be bunched together around the center of user 24, as shown in FIG. 1.

Front torso strap 36 can have elastic characteristics to accommodate different dimensions of user 24. Additionally, elastic characteristics can help retain gathering member 60 and central portion 80 of scarf 22 close to the front portion of user 24 during movement. The use of a front torso strap 36 having elastic characteristics can facilitate the comfort of user 24 when wearing harness 20 with scarf 22 secured thereto. The elastic characteristics can allow front torso strap 36 to stretch and deform as user 24 goes about their normal daily activity which can include various movements of the body.

Rear torso strap 30 and shoulder straps 46, 48 can be elastic or non-elastic. Additionally, rear torso strap 30 and shoulder straps 46, 48 can be a fixed length or have adjustable lengths.

Referring now to FIG. 8, an alternate configuration of a scarf harness 120 is shown. Scarf harness 120 is similar to scarf harness 20 discussed above. As such, only the main differences therebetween will be described. In scarf harness 120, front and rear torso straps 136, 130 are a single continuous strap. As such, torso portion 126 has a single strap. Clips 142 are attached to appropriate locations on torso portion 126 and can be used in lieu of internal fastening devices 56 discussed above with reference to scarf harness 20. Gathering member 160 can be fixedly coupled to torso portion 126. Additionally, shoulder portion 128 can also be a single continuous strap that is secured to torso portion 126 with shoulder straps 146, 148 extending upwardly therefrom. Again, clips 142 can be attached to the ends of shoulder straps 146, 148 in lieu of the internal fastening devices 56 discussed above with reference to scarf harness 20.

Referring now to FIG. 9, another alternate configuration of a scarf harness 220 is shown. Scarf harness 220 is similar to scarf harness 20 discussed above. As such, only the main differences will be described. In scarf harness 220, the rear torso strap of torso portion 226 and shoulder portion 228 are integral with one another and can be formed from a single continuous piece of material. As such, scarf harness 220 covers a significantly larger area of the back portion of user 24 of scarf harness 220. End 238 of front torso strap 236 can be fixedly coupled to end 232 while free end 240 can be selectively coupled to end 234 of torso portion 226.

Referring now to FIG. 10, yet another configuration of a scarf harness 320 according to the present teachings is shown. Scarf harness 320 is similar to scarf harness 20 discussed above. As such, only the main differences will be described. Scarf harness 320 can include a plurality of fastening devices 390 attached to shoulder straps 346, 348 and rear torso strap 330. Fastening devices 390 can be utilized to attach a decorative cover 392 over the back side of scarf harness 320. For example, fastening devices 390 can be one part of a hook-and-loop fastener while cover 392 includes the other part of the hook-and-loop fastener. Cover 392 can then be removably attached to the rear of scarf harness 320 to cover at least a portion of shoulder portions 328 and torso portion 326. Cover 392 can take a variety of shapes, configurations and have a variety of patterns or colors. By way of non-limiting example, cover 392 can be shaped like a shell (as shown), a butterfly, or a flower. As such, scarf harness 320 allows various decorative covers 392 to be secured thereto to further enhance the pattern of scarf 22 and complement the clothing of user 24. Additionally, front torso strap 336 is completely removable from rear torso strap 330. To facilitate this, rear torso strap 330 can include clips 342 adjacent left and right ends 332, 334 that allow front torso strap 336 to be selectively secured thereto.

While a scarf harness according to the present teachings has been described and illustrated with reference to various configurations, it should be appreciated that such descriptions and illustrations are merely exemplary in nature and that changes and deviations to the scarf harnesses shown can be made. For example, the various features of the different configurations can be mixed or matched to provide a desired scarf harness. Additionally, the dimensions and spacing of various features of the scarf harnesses can be changed from that shown to provide a desired aesthetically pleasing appearance. Moreover, other types of fastening devices and means, such as buttons and snaps by way of non-limiting example, can be utilized on the scarf harness. As such, such changes and alterations are within the present teachings and should not be construed as deviating from the spirit and scope of the claims.

What is claimed is:

1. A clothing accessory comprising:

a first torso portion having a length and at least two free ends and operable to be disposed around a portion of a torso of a user;

a second torso portion having a first end fixedly connected to one of said free ends of said first torso portion and a second end releasably connected to a second one of said free ends of said first torso portion when disposed around a different portion of the torso of the user;

a shoulder portion extending from said first torso portion and having at least two free ends and operable to be disposed along a back side of a user and extend upwardly from said first torso portion having the free ends located proximate a shoulder area of the user;

a plurality of fastening devices, at least one of said fastening devices associated with each free end of said shoulder portion to retain portions of a clothing article to said shoulder portion free ends with the clothing article extending along a front side of the user, and individual ones of said fastening devices being connected to said first torso portion at each of said at least two free ends and retaining different portions of said clothing article thereto; and a gathering member coupled to said second torso portion and having a central opening therein receiving adjacent ends of said clothing article followed by further insertion of said clothing article until a central portion of said clothing article is positioned in said central opening, said central opening acting to bunch said central portion of the clothing article together, one of said adjacent ends of said clothing article thereafter connected to one of said free ends of said shoulder portion using one of said fastening devices; a first corner and a fourth corner of said clothing article thereafter being coupled to said first and second fasteners at said shoulder portions free ends, and a second and third corners thereafter being free to move.

2. The clothing accessory of claim 1, wherein said fastening devices include a resilient member operable to be compressed and form an opening therein that can receive a portion of the clothing article and collapses upon removal of a compressive force.

3. The clothing accessory of claim 1, wherein said fastening devices are clips.

4. The clothing accessory of claim 1, wherein said second torso portion has an elastic characteristic.

5. The clothing accessory of claim 1, wherein said gathering member is a ring member fixedly coupled to said second torso portion.

6. The clothing accessory of claim 1, wherein said second torso portion extends through said opening in said gathering member.

7. The clothing accessory of claim 1, wherein said first and second torso portions are a single integral portion.

8. The clothing accessory of claim 1, wherein said shoulder portion and said first torso portion are a single integral portion.

9. The clothing accessory of claim 1, wherein said first and second torso portions each have two ends and one end of each of said torso portions are fixedly coupled together.

10. The clothing accessory of claim 1, wherein said shoulder portion includes two straps that extend upwardly from said first torso portion.

11. The clothing accessory of claim 1, wherein the article of clothing has a butterfly shape on said front side of the user.

12. The clothing accessory of claim 1, wherein said shoulder portion and said first torso portion each have fasteners thereon that allow a clothing article to be selectively attached thereto and extend along a back side of a user.

13. A clothing accessory comprising:

a pair of rear shoulder straps spaced apart and each having a first fastener thereon individually operable to couple one of adjacent first and second corners of a clothing article to one of said shoulder straps;

a rear torso strap coupled to said shoulder straps and having first and second ends, said first end having a second fastener thereon;

an elastic front torso strap having a first end fixedly connected to said first end of said rear torso strap and a second end releasably connected to said second fastener at said second end of said rear torso strap; and a gathering member coupled to said front torso strap having a central opening extending therethrough and through which said second corner and an adjacent third corner of said clothing article are inserted followed by further insertion of said clothing article through said central opening until a central portion of said clothing article is positioned in said central opening to bunch said central portion together, said first corner and a fourth corner of said clothing article thereafter being coupled to said first and second fasteners, and said second and third corners thereafter being free to move.

14. The clothing accessory of claim 13, wherein said first and second fasteners include a resilient member operable to be compressed and form an opening therein that can receive a portion of the clothing article and collapse upon removal of a compressive force.

15. The clothing accessory of claim 13, wherein said shoulder straps and said rear torso strap are integral with one another.

16. A clothing accessory comprising:

a rear torso strap having opposed first and second ends;

multiple fastening devices including a first one individually integrally connected to one of the first or second ends;

first and second rear shoulder straps connected to the rear torso strap, each extending upwardly from the rear torso strap to a shoulder area of a user and each having a second or third one of the fastening devices at a shoulder strap end releasably coupling opposed first and second corners of a clothing article to the first and second shoulder straps;

a front torso strap fixed to one of the first or second ends of the rear torso strap and having a free end releasably connected to the other one of the first or second ends using the first one of the fastening devices; and a closed loop gathering member having an opening extending therethrough, the gathering member received on the front torso strap and having a center portion of the clothing article extending through the opening when the first and second corners are connected to the first and second shoulder straps and third and fourth corners of the clothing article are free to move.

17. The clothing accessory of claim 16, wherein the front torso strap is received in the opening of the gathering member permitting the gathering member to slide with respect to the front torso strap.

18. The clothing accessory of claim 16, wherein the gathering member is fixed to the front torso strap.

19. The clothing accessory of claim 16, wherein the clothing article is a rectangular shaped scarf including first, second, third and fourth sides providing the first, second, third and fourth corners, wherein the first and third sides are oppositely positioned and are fastened to the first and second ends of the rear torso strap.

* * * * *